United States Patent [19]

Mädge et al.

[11] Patent Number: 4,531,852

[45] Date of Patent: Jul. 30, 1985

[54] PRINTING APPARATUS OF MODULAR CONSTRUCTION HAVING A ROTATABLE PRINTHEAD AND PLURAL PRINT STATIONS

[75] Inventors: Werner Mädge, Villingen-Schwenningen; Peter Vogelhuber, Brigachtal; Dieter Stellmach, Bad Dürrheim; Josef Hauger, Villingen-Schwenningen, all of Fed. Rep. of Germany

[73] Assignee: Kienzle Apparatus GmbH, Villingen, Fed. Rep. of Germany

[21] Appl. No.: 471,784

[22] Filed: Mar. 3, 1983

[30] Foreign Application Priority Data

Mar. 6, 1982 [DE] Fed. Rep. of Germany ..... 3208111

[51] Int. Cl.[3] ..... B41J 29/02

[52] U.S. Cl. ..... 400/692; 400/82; 400/266.2; 400/356; 400/680

[58] Field of Search ..... 400/82, 88, 91, 92, 400/93, 94, 266.2, 355, 356, 357, 358, 605, 680, 683, 684, 692

[56] References Cited

U.S. PATENT DOCUMENTS

| | | | |
|---|---|---|---|
| 893,826 | 7/1908 | Woodward | 400/266.2 |
| 1,455,030 | 5/1923 | Roberts | 400/266.2 X |
| 1,493,553 | 5/1924 | Lehmann | 400/692 |
| 1,841,932 | 1/1932 | Bourquin | 400/680 X |
| 2,408,452 | 10/1946 | Stixrud | 400/680 X |
| 2,540,297 | 2/1951 | Freeman et al. | 400/680 X |
| 2,603,336 | 7/1952 | Julliard | 400/88 |
| 4,253,774 | 3/1981 | Hanakata et al. | 400/88 X |
| 4,348,125 | 9/1982 | Fujiwara et al. | 400/605 X |
| 4,375,923 | 3/1983 | Hidaka et al. | 400/82 |
| 4,391,542 | 7/1983 | Baitz | 400/605 |
| 4,401,025 | 8/1983 | Vogelhuber et al. | 400/82 |

FOREIGN PATENT DOCUMENTS

| | | | |
|---|---|---|---|
| 2517461 | 10/1976 | Fed. Rep. of Germany | 400/82 |
| 2541996 | 3/1977 | Fed. Rep. of Germany | 400/82 |
| 2823153 | 11/1979 | Fed. Rep. of Germany | 400/82 |
| 3144388 | 5/1983 | Fed. Rep. of Germany | 400/636 |
| 0086771 | 7/1981 | Japan | 400/82 |
| 0051478 | 3/1982 | Japan | 400/82 |
| 0053385 | 3/1982 | Japan | 400/82 |
| 0075880 | 5/1982 | Japan | 400/88 |
| 2037665 | 7/1980 | United Kingdom | 400/88 |
| 2046671 | 11/1980 | United Kingdom | 400/88 |

*Primary Examiner*—Ernest T. Wright, Jr.

*Attorney, Agent, or Firm*—Toren, McGeady, Stanger, Goldberg & Kiel

[57] ABSTRACT

A printing apparatus of modular construction includes a printing mechanism with a pivotally mounted printing head, a continuous form feed part and an individual form feed part. To provide a compact construction in which the printing operation can be viewed by the operator, the individual form feed part is constructed as a base unit so that the individual form is fed into the apparatus and transported horizontally. The printing mechanism and continuous form feed part are positioned above the base unit. As a result, with the apparatus mounted on a table, printing on the printing base of the continuous form feed part takes place below the eye level of the operator. To insert the continuous form, the continuous form feed part can be pivoted away from the printing mechanism. In addition, the printing mechanism and the continuous form feed part can be pivoted relative to the base unit to gain access to the path of the individual forms on the base unit.

9 Claims, 3 Drawing Figures

PRINTING APPARATUS OF MODULAR CONSTRUCTION HAVING A ROTATABLE PRINTHEAD AND PLURAL PRINT STATIONS

SUMMARY OF THE INVENTION

The present invention is directed to a printing apparatus of modular construction and is made up of a printing mechanism, an individual form feed part, and a continuous form feed part with each form feed part having a printing base and the printing mechanism includes a printing head which is pivotally mounted so that it can be moved between the position where an individual form or form set is printed and another position where a continuous form or form set is printed.

Such apparatus is disclosed in the German Auslegeschrift No. 28 23 153. Pivotally mounting the printing head so that it can interact with two different printing bases has the considerable advantage that in the individual form feed part as well as in the continuous form feed part, form sets of any thickness can be transported, because the forms are not printed in a print penetration process. There is also the advantage that the two form feed parts are completely independent from one another so that there are no limitations on the size of the forms to be printed as in the case in the print penetration process, because the different forms can be printed independently from one another.

In this known arrangement there is the disadvantage that the printing head prints a continuous form, working from the top towards the bottom and the individual form feed part is arranged so that it is accessible from the front whereby the printing takes place, so to speak, from the rear to the front. Therefore, the printing areas or locations cannot be viewed by the operator. Moreover, in the known printing apparatus thre is the disadvantage that a relatively large space is required, so that it is suitable only as a floor unit and not as an apparatus which can be operated mounted on a table.

Starting from this known state of the art, the primary object of the present invention is to modify a printing apparatus of modular construction so that it can be used as a compact table top unit with the printing operations being visible at all times to the operator without having to rearrange interfering paper supply stacks and the like in the operating area. Accordingly, in the present invention the individual form feed part is arranged as a removable base unit over which the individual forms or sets of forms are fed in the horizontal position approximately at the level of the table. The printing mechanism and the continuous form feed part are arranged one behind the other above the removable base unit so that the printing operation on the base of the continuous form feed part can be viewed at a location below eye level.

Practical applications have shown that in corporate forms as used in electronic data processing units, the continuous forms are of greater importance than the individual form. Therefore, the printing apparatus is intentionally designed so that the printing mechanism is combined with a continous form feed part and, optionally, an individual form feed part can be added. Due to the special construction and arrangement of the individual form feed part, the printing apparatus as such is not significantly enlarged for the operator, and printing on a continous form can be viewed and takes place below eye level so that the printing process can be checked during operation.

In addition, the invention provides a printing apparatus which is easy to operate and to service, so that small functional problems, particularly paper jams, can be corrected by the operator without requiring the assistance of a service technician. Moreover, in accordance with the present invention, the insertion of the continuous form is made as simple as possible. For such insertion, in accordance with the present invention, the continuous form feed part can be pivoted to the open position and, it is also possible to swing both the printing mechanism and the continuous form feed part into the open position.

Due to the hinged construction of the continuous form feed part as well as of the individual form feed part, it is possible for the operator to correct paper jams. Moreover, with the arrangement of the apparatus embodying the present invention, a customer service technician has better access to the various operating parts of the printing apparatus for checking possible operating problems. With the continuous form feed part being pivotally mounted in the apparatus, the insertion of a new strip of forms is significantly facilitated as in the replacement of the ink ribbon cassette. In the continuous form feed part, the continous form is inserted from the rear, it is guided around the feed elements located on both sides of the printing base and then is guided out in the rearward direction. As a result, the paper supply stacks and the paper deposit stacks are located behind the machine, that is, not in the work area of the operator. In addition, individual forms can be fed in horizontally at about table level which is an important feature for ease in the operation of the printing apparatus.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAIL DESCRIPTION OF THE INVENTION

Figure 1:
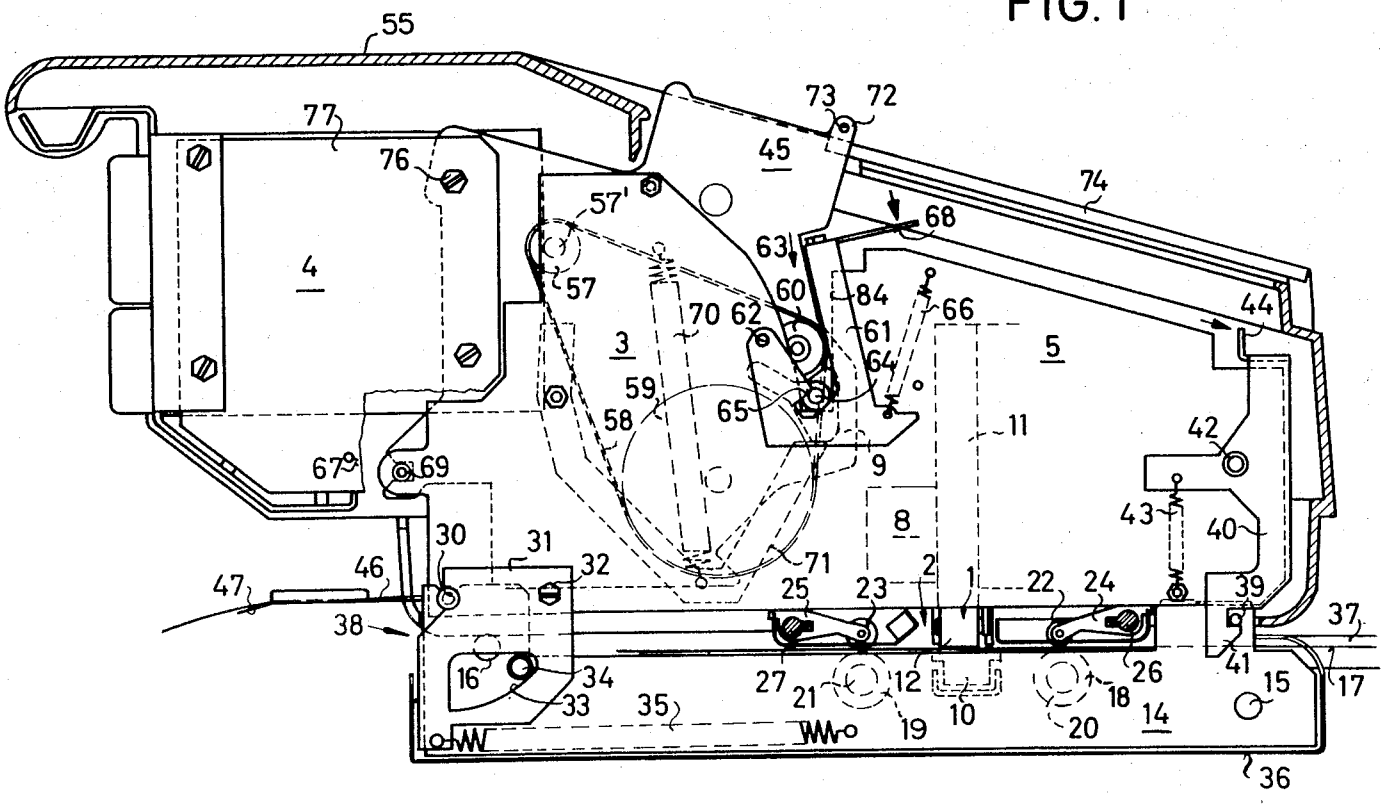
FIG. 1 is a side view of a printing apparatus embodying the present invention and illustrated in the closed position.
Figure 2:
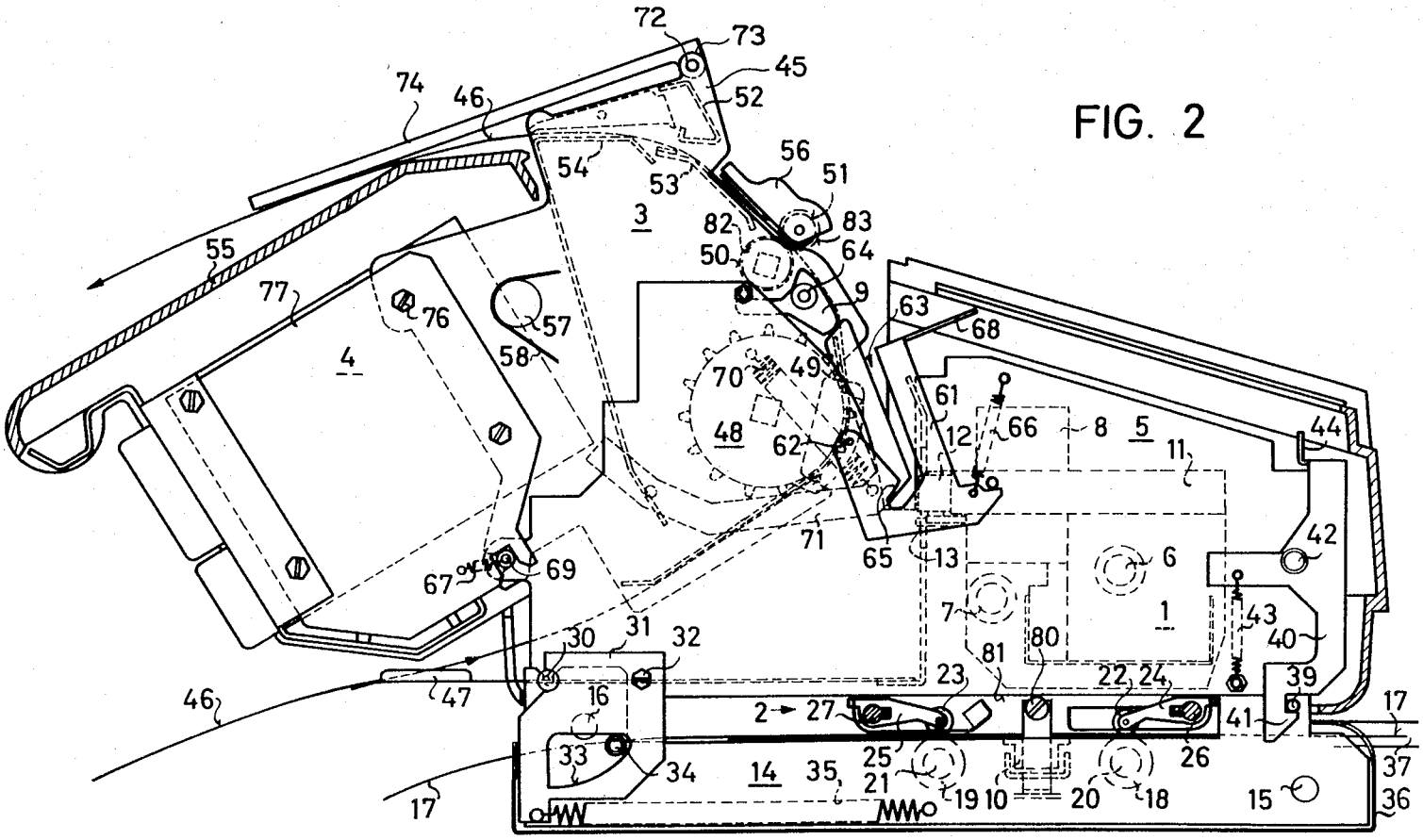
FIG. 2 is a view similar to FIG. 1, however, showing the printing apparatus with the continuous form feed part pivoted into the open position.

The printing apparatus embodying the present invention is made up of four main parts, a printing mechanism 1, an individual form feed part 2 constructed as a base unit, a continuous form feed part 3 and an electronic control 4. The printing mechanism 1, particularly in FIGS. 2 and 3, includes side walls 5 with two axles 6, 7, note FIG. 2, extending between them so that a printing head 8 in the printing mechanism 1 can be moved into position opposite the printing bases 9 and 10. One printing base 9 is a part of the continuous form feed part 3 while the other printing base 10 is a component of the individual form feed part 2. In FIG. 2 the printing head 8 is in position to interact with the printing base 9 while in FIG. 1 the printing head 8 is in position to interact with the printing base 10. The device for effecting this movement is described in U.S. Pat. No. 4,401,025.

Figure 3:
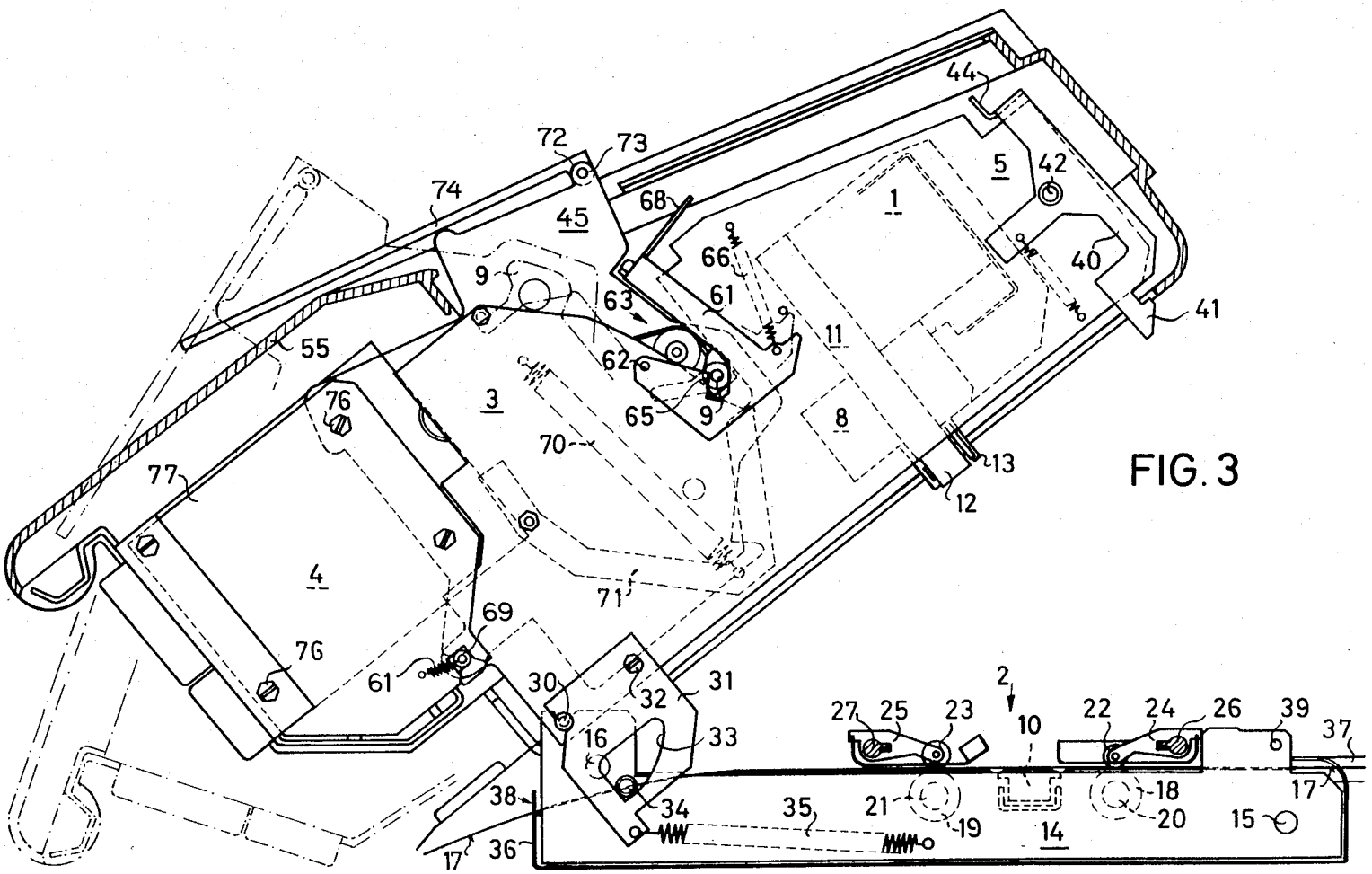
FIG. 3 is a view similar to FIG. 1, however, both the printing mechanism and the continuous form feed part of the printing apparatus are pivoted into the open position.

In FIG. 2 the ink ribbon cassette 11 cam be noted while in FIG. 3 the ink ribbon 12 is shown and it is guided around the opening of the printing head 8 which, preferably, is a needle printing head. A scanning roller 13 located at the ink ribbon 12 scans the paper thickness so that the needle printing head 8 is always in the correct position relative to the cooperating printing base 9 and 10, independently of its thickness.

As viewed in the drawing, the right-hand side is the front of the printing mechanism 1 while the left-hand side is the rear. Printing mechanism 1 is located in the front of the apparatus and the individual form feed part 2, that is, the base unit, is positioned below the printing mechanism 1. The continuous form feed part 3 is located on the rear side of the printing mechanism 1 and is located above the base unit or form feed part 2. Individual form feed part 2 includes side walls 14 arranged on both sides of the apparatus and connected together by cross bars 15, 16. The feed of the forms 17 which may be individual sheets of various thickness as well as form sets, such as sets of invoice forms or the like, is effected by feed rollers 18, 19 arranged on shafts 20, 21, respectively, and driven by a motor. Pressure rollers 22, 23 interact with the feed rollers 18, 19 and the pressure rollers 22, 23 are each supported on a lever 24, 25 and can be moved into and out of the operating position with the feed rollers 18, 19 by means of the shafts 26, 27. The drive and control of the feed is effected by motors, not shown. Such motors are shown and explained more in detail in German Offenlegungsschrift No. 31 44 388.

A support bolt 30 is located toward the rear of the side walls 5 of the printing mechanism 1 if the individual form feed part 2 is to be combined with the printing mechanism 1. The side walls 5 can be pivoted relative to the side walls 14 of the individual form feed part 2 about the supporting bolt 30. To interconnect the printing mechanism 1 with the individual form feed part 2 a connecting part 31 is mounted on the bolt 30 and is attached to the side walls 5 by a screw 32. The connecting part 31 has a recess 33. The recess 33 has an arc-shaped surface movable relative to a guide bolt 34 secured in the side wall 14 of the individual form feed part 2. A spring 35 extending in the front end-rear end direction of the individual form feed part 2, is connected at one end to the side wall 14 and at its other end to the connecting part 31 and aids in the transfer of the load during the pivotal movement of the printing mechanism 1 and the continous form feed part 3 relative to the base unit or individual form feed part 2. The spring 35 relaxes when the printing mechanism 1 is lifted from the position shown in FIG. 1 into the position shown in FIG. 3 and thus facilitates the pivoting operation. When the printing mechanism 1 is returned into the operative position, the spring 35 is again stressed and the movement of the printing mechanism 1 is simultaneously dampened. The connecting part 31 functions to connect the side walls 5 and 14 and to guide the side walls 5 during the pivoting operation with the guide bolt 34 rolling on the arc-shaped surface of the recess 33. The individual form feed part 2 is completely enclosed by a shell 36 with the only opening being an insertion shaft 37 for feeding in the individual forms 17. A form outlet opening 38 for the individual forms 17 is located at the rear of the individual form feed part 2. Only the connecting part 31 is required to connect the printing mechanism 1 and the individual form feed part 2 along with a click-stop device described below.

At the front end of the side wall 14, a stop bolt 39 is positioned for interaction with a stop lever 40 located on the side wall 5. Stop lever 40 has a stop projection 41 at its lower end which engages behind the stop bolt 39 on the side wall 14 of the individual form feed part 2. The lever 40 is pivotally supported on a bolt 42 and is biased by a spring 43 about the bolt 42 in the counter-clockwise direction. At the upper end 44 of the lever 40, the operator can pivot the stop lever 40 clockwise and release the engagement between the stop bolt 39 and the stop projection 41 on the lever 40. The parts designated by reference numerals 39 to 44 form a first click-stop device. When the click-stop device is actuated, the combination of the printing mechanism 1, the continuous form feed part 3 and the control 4 pivot from the position illustrated in FIG. 1 into the position shown in FIG. 3 where the printing mechanism 1 and the continuous form feed part 2 are in position to afford access to the individual forms 17 and to relieve any possible paper jams. Similarly, in this position, a customer service technician can remove the individual form feed part 2 to repair it or replace it with another unit.

The exact position of the printing base 10 on the individual form feed part 2 and the opening of the printing head 8 in the printing mechanism 1 is secured relative to one another by a roller 80, note FIG. 2, at the side wall 14 resting resiliently against an edge 81 of the printing mechanism 1, that is, the entire individual form feed part 2 consisting of the parts designated by reference numerals 10 and 18 to 27 is pressed resiliently against the edge 81.

As mentioned above, printing head 8 of the printing mechanism 1 is in the position shown at FIG. 2 cooperating with the printing base 9 of the continuous form feed part 3. Continuous form feed part 3 is supported between side walls 45 and is shown in the operative position in FIG. 1 and pivoted out of the operative position in FIGS. 2 and 3. Continuous forms 46 are fed over a guide plate 47 from the rear of the apparatus and, as shown in FIG. 2, are guided around a pinwheel 48 and are firmly held by a clamping device 49. The continuous form 46 is then guided over the printing base 9 by a pair of friction rollers 50, 51. From the printing base 9, the continuous form moves between guide parts 52, 53, 54 and 55.

The friction rollers 50, 51, positioned on opposite sides of the continuous form 46, are driven at different speeds so that greater action is exercised on the upper form sheet than on the lower form sheet. Roller 51 is supported on folding levers 56 which can be pivoted outwardly for inserting the continuous form 46 to facilitate the threading of the form 46 through the apparatus. While FIG. 2 illustrates the driving elements which interact with the form 46 in the continuous form feed part 3, in FIG. 1 a belt pulley 57 is located on a motor shaft 57′ and drives a belt 58 which, in turn, drives a pulley 59 which drives the pinwheel 48 and a pulley 60 which drives the friction roller 50. The feed or friction rollers 50, 51 are in driving connection by means of gear wheels 82, 83, note FIG. 2. The form 46 is driven by the pinwheel 48 and the friction rollers 50, 51. The printing base 9 is positioned between the pinwheel 48 and the friction rollers 50, 51. The insertion of the continuous form 46 can be effected by pivoting the flap element 49, 56 outwardly and then these elements 49, 56 can be returned inwardly to the engaged position following the insertion of the continuous form 46.

A click-stop device for the continuous form feed part 3 consists of a stop lever 61 mounted on a bolt 62 located on the side wall 5. A cutout 63 is located in the side wall 5 with a right side boundary edge 84, as viewed in FIG. 1, with a stop bolt 64 extending through the cutout 63 and projecting laterally beyond the printing base 9 and the side wall 5 so that it can interact with a stop projection 65 on the stop lever 61. Stop lever 61 is biased in the counterclockwise direction by a spring 66 so that in the operative position it holds the continuous form feed part 3 at the printing base 9 or at the bolt 64, or clamps the bolt 64 between the boundary edge 84 of the cutout 63 in the side wall 5 and the stop projection 65 on the stop lever 61. Toward the rear, a spring 67 pulls in the direction from left to right on the side wall 45 of the continuous form feed part 3 so that in the operative position, the stop bolt 64 is clamped securely between the boundary edge 84 of the cutout 63 and the stop projection 65 on the stop lever 61. Accordingly, the printing base 9 has a defined position between the projection 65 and the boundary edge 84 of the cutout 63 in the side wall 5. The stop lever 61 has an extension 68 at its upper end so that the stop lever 61 can be pressed downwardly and clockwise against the force of the spring 66 to release the engagement between the locking bolt 64 and the locking projection 65.

When the stop lever 61 is moved into the released position, the continuous form feed part 3 can be pivoted about a bolt 69 supported in the side wall 5 and also in the side wall 45 of the continuous form feed part 3. Since the mass of the continuous form feed part 3 is located to the right of the pivot point formed by the bolt 69, a weight relief is afforded by a spring 70 which acts, by means of a lever 71, on the printing base 9 to facilitate the pivotal movement of the continuous form feed part 3.

In FIG. 3, it can be seen that during the pivoting motion of the lever 71, the spring 70 is relaxed and fulfills its weight relief function. As can be seen in FIG. 1, a translucent cover 74 is pivotally mounted on a bolt 73 supported in an eye 72. The translucent cover 74 serves as a covering over the printing mechanism 1. In FIG. 2 the cover 74 is pivoted rearwardly so that the stop lever 61 and its extension 68 are accessible.

Lateral walls 77 are connected by spacers 76 with the side walls 45 of the continuous form feed part 3 and the circuit boards, not shown for the electronic components, not shown of the control 4 are located between the walls 77. These parts are shown in general as the electronic control 4.

As mentioned earlier, the printing apparatus is intended to be mounted on a table. As shown in FIG. 3, when the printing mechanism 1 is pivoted out of the operating position, the continuous form feed part 3 can be further pivoted, as shown in broken lines, without touching the surface of the table on which the shell 36 of the individual form feed part 2 rests. Therefore, both of the printing mechanism 1 and the continuous form feed part 3 can be pivoted although the printing apparatus is mounted on a table.

During the use of the printing mechanism 1 with only the continuous form feed part 3, feet, not shown, can be screwed into the printing mechanism 1 so that the apparatus can be placed on a table without the base unit or individual form feed part 2.

While specific embodiments of the invention have been shown and described in detail to illustrate the application of the inventive principles, it will be understood that the invention may be embodied otherwise without departing from such principles.

We claim:

1. A printing apparatus of a modular construction comprising a printing mechanism having laterally spaced first side walls, an individual form feed part including a first printing base and having laterally spaced second side walls, and a continuous form feed part including a second printing base and having laterally spaced third side walls, said printing mechanism including a printing head located between said first side walls, said printing head being pivotally mounted for pivoting said printing head from a first position relative to said individual form feed part for printing individual forms or form sets to a second position relative to said continuous form feed part for printing a continuous form or form sets, said printing apparatus having a front end and a rear end with said first, second and third side walls extending in the direction between the front and rear ends, said first and third side walls being located above said second side walls, wherein the improvement comprises that said individual form feed part comprises a removable base unit arranged to be supported on a table below said printing mechanism so that the individual form or form set is fed horizontally closely above the level of the table, said base unit and said printing mechanism extend from the front end toward the rear end and said second printing base of said continuous form feed part is located above said removable base unit and is positioned between said printing mechanism and the rear end so that printing on said second printing base is visible and is located below eye level, said printing mechanism and said continuous form feed part are pivotally mounted relative to said individual form feed part so that said printing mechanism and continuous form feed part can be pivoted outwardly away from said individual form feed part, a first click-stop device formed on said individual form feed part and said printing mechanism secures said printing mechanism in the operative position relative to said individual form feed part, first pivot means for pivoting said printing mechanism relative to said first printing base located at the end of said first printing base located closer to the rear end of said printing apparatus, and second pivot means for pivoting said second printing base relative to said printing mechanism located at the end of said printing mechanism closer to the rear end of said printing apparatus and spaced upwardly from said first pivot means.

2. A printing apparatus, as set forth in claim 1, wherein a second click-stop device is arranged for securing said printing mechanism and said continuous form feed part in the operative position.

3. A printing apparatus, as set forth in claim 1, wherein a weight relief spring is attached to said individual form feed part and to said printing mechanism for counter-balancing movement of said printing mechanism and continuous form feed part relative to said individual form feed part.

4. A printing apparatus of a modular construction comprising a printing mechanism, having laterally spaced first side walls, an individual form feed part including a first printing base and having laterally spaced second side walls, and a continuous form feed part including a second printing base and having laterally spaced third side walls, said printing mechanism including a printing head, said printing head being pivotally mounted for pivoting said printing head from a first position relative to said individual form feed part for printing individual forms or form sets to a second position relative to said continuous form feed part for printing a continuous form or form sets, said printing apparatus having a front end and a rear end with said first, second and third side walls extending in the direction between the front and rear ends, said first and third side walls being located above said second side walls, wherein the improvement comprises that said individual form feed part comprises a removable base unit arranged to be supported on a table below said printing mechanism so that the individual form or form set is fed horizontally closely above the level of the table, said base unit and said printing mechanism extend from the front end toward the rear end and said second printing base of said continuous form feed part is located above said removable base unit and is positioned between said printing mechanism and the rear end so that printing on said second printing base is visible and is located below eye level, said printing mechanism and said continuous form feed part are pivotally mounted relative to said individual form feed part so that said printing mechanism and continuous form feed part can be pivoted outwardly away from said individual form feed part, and a first click-stop device formed on said individual form feed part and said printing mechanism secures said printing mechanism in the operative position relative to said individual form feed part, said continuous form feed part is pivotally mounted relative to said printing mechanism and can be pivoted away from said printing mechanism, a second click-stop device is arranged for securing said printing mechanism and said continuous form feed part in the operative position, first pivot means for pivoting said printing mechanism relative to said first printing base located at the end of said first printing base located closer to the rear end of said printing apparatus and, second pivot means for pivoting said second printing base relative to said printing mechanism located at the end of said printing mechanism closer to the rear end of said printing apparatus and spaced closer to the rear end of said printing apparatus and spaced upwardly from said first pivot means.

5. A printing apparatus, as set forth in claim 2 or 4, wherein said printing mechanism has an upper surface spaced upwardly from said individual form feed part, and a cover pivotally mounted on said upper surface of said printing mechanism and said cover can be pivoted upwardly from said upper surface for affording access to said first and second click-stop devices for releasing said devices.

6. A printing apparatus, as set forth in claim 2 or 4, wherein said second click-stop device securing said continuous form feed part to said printing mechanism includes a pivotal stop lever and a stop projection engageable with said stop lever, and said stop projection is an extension of said second printing base.

7. A printing apparatus, as set forth in claim 2 or 4, wherein a spring acts as a weight relief member when said continuous form feed part is pivotally displaced relative to said printing mechanism.

8. A printing apparatus of a modular construction comprising a printing mechanism, an individual form feed part including a first printing base, and a continuous form feed part including a second printing base, said printing mechanism including a printing head, said printing head being pivotally mounted for pivoting said printing head from a first position relative to said individual form feed part for printing individual forms or form sets to a second position relative to said continuous form feed part for printing a continuous form or form sets, wherein the improvement comprises that said individual form feed part comprises a removable base unit arranged to be supported on a table below said printing mechanism so that the individual form or form set is fed horizontally closely above the level of the table, and said second printing base of said continuous form feed part is located above said removable base unit so that printing on said second printing base is visible and is located below eye level, said printing mechanism and said continuous form feed part are pivotally mounted relative to said individual form feed part so that said printing mechanism and continuous form feed part can be pivoted outwardly away from said individual form feed part, a first click-stop device formed on said individual form feed part and said printing mechanism secures said printing mechanism in the operative position relative to said individual form feed part, said continuous form feed part is pivotally mounted relative to said printing mechanism and can be pivoted away from said printing mechanism, a second click-stop device is arranged for securing said printing mechanism and said continuous form feed part in the operative position, said printing mechanism is pivotally displaceable about a first pivot axis relative to said individual form feed part, and said continuous feed part is pivotal about a second pivot axis relative to said printing mechanism so that said printing mechanism and said continuous form feed part can be pivoted outwardly from the operative position to the open position without traversing the plane of the lower surface of said individual form feed part arranged to be supported on a table.

9. A printing apparatus of a modular construction comprising a printing mechanism, an individual form feed part including a first printing base, and a continuous form feed part including a second printing base, said printing mechanism including a printing head, said printing head being pivotally mounted for pivoting said printing head from a first position relative to said individual form feed part for printing individual forms or form sets to a second position relative to said continuous form feed part for printing a continuous form or form sets, wherein the improvement comprises that said individual form feed part comprises a removable base unit arranged to be supported on a table below said printing mechanism so that the individual form or form set is fed horizontally closely above the level of the table, and said second printing base of said continuous form feed part is located above said removable base unit so that printing on said second printing base is visible and is located below eye level, said printing mechanism and said continuous form feed part are pivotally mounted relative to said individual form feed part so that said printing mechanism and continuous form feed part can be pivoted outwardly away from said individual form feed part, and a first click-stop device formed on said individual form feed part and said printing mechanism secures said printing mechanism in the operative position relative to said individual form feed part, said continuous form feed part is pivotally mounted relative to said printing mechanism and can be pivoted away from said printing mechanism, a second click-stop device is arranged for securing said printing mechanism and said continuous form feed part in the operative position, said printing mechanism is pivotally displaceable about a first pivot axis relative to said individual form feed part, and said continuous form feed part is pivotal about a second pivot axis relative to said printing mechanism so that said printing mechanism and said continuous form feed part can be pivoted outwardly from the operative position to the open position without traversing the plane of the lower surface of said individual form feed part arranged to be supported on a table.

* * * * *